United States Patent [19]

Shindoll et al.

[11] 4,145,849

[45] Mar. 27, 1979

[54] ADJUSTABLE SHELF SYSTEM

[76] Inventors: Joseph L. Shindoll, 709 Belmont; Jerry D. Clark, 601 Carpenter, both of Garland, Tex. 75040

[21] Appl. No.: 902,410

[22] Filed: May 3, 1978

[51] Int. Cl.[2] ..... A47B 53/00

[52] U.S. Cl. ..... 52/36; 52/239; 108/47; 108/111; 211/86

[58] Field of Search ..... 108/42, 47, 48, 110, 108/111, 107, 108, 109, 152; 211/86, 153; 52/36, 239

[56] References Cited

U.S. PATENT DOCUMENTS

| | | | |
|---|---|---|---|
| 2,182,422 | 12/1939 | Bond | 108/42 X |
| 2,346,150 | 4/1944 | Brown | 108/42 X |
| 2,991,040 | 7/1961 | Levy | 108/108 X |
| 3,248,828 | 5/1966 | Shackelford | 108/42 X |
| 3,471,978 | 10/1969 | Fenwick | 108/42 X |
| 3,538,842 | 11/1970 | Labbato | 108/48 X |
| 3,771,466 | 11/1973 | Ferdinand et al. | 108/111 X |
| 3,828,937 | 8/1974 | Nash | 211/86 |
| 3,948,581 | 4/1976 | Helman et al. | 211/86 X |

*Primary Examiner*—Roy D. Frazier
*Assistant Examiner*—Peter A. Aschenbrenner
*Attorney, Agent, or Firm*—Dennis T. Griggs

[57] ABSTRACT

An adjustable shelf system for installation in combination with a non-load bearing wall which does not require penetration of the wall for support is disclosed. The adjustable shelf system is particularly well suited for use in combination with non-load bearing walls of the type supported intermediate a building foundation and an upstanding load bearing frame which includes a top track member having channels for receiving studs and prefabricated wall panels. Shelves are supported on brackets which are attached to laterally spaced, upstanding tubular support legs having a channel formed within one side wall portion. A cushion strip is confined in the channel intermediate the upstanding tubular support legs and the non-load bearing wall thereby preventing abrasive contact of the tubular support legs against the adjacent wall paneling. In a preferred embodiment, an extendable tubular member is coaxially received within the central chamber of each of the tubular support legs and projects above the tubular support legs to an elevation substantially flush with the top side surface of the top track member. Fastener means are provided for mechanicaly interconnecting the extendable tubular member to the top track member for preventing lateral displacement of the tubular support legs relative to the wall paneling.

8 Claims, 12 Drawing Figures

ADJUSTABLE SHELF SYSTEM

BACKGROUND OF THE INVENTION

1. Field of the Invention

The present invention relates generally to prefabricated structural systems and more specifically relates to a prefabricated adjustable shelf system which is particularly well suited for installation in combination with non-load bearing decorative walls.

2. Description of the Prior Art

Prefabricated and prefinished non-load bearing walls having a decorative exterior surface have been used for many years in the construction of modern office buildings. According to a common arrangement, the non-load bearing wall is supported intermediate a floor or foundation and an upstanding load bearing frame projecting from the floor which includes a metallic top track member. The top track member is typically a length of extruded aluminum having a central channel for receiving wooden or metal studs and a smaller channel on each side of the central channel for receiving prefabricated wall paneling. The prefabricated wall paneling is typically prefinished wood veneer or a substrate covered by a vinyl overlay. This prefinished wall panel is relatively expensive and its replacement represents a significant percentage of the cost associated with renovating an office. Such walls are often damaged by the installation of bookshelves which require a number of fasteners to anchor the shelves to the wall.

In some cases it is desirable to install a bookshelf or other shelving adjacent a non-load bearing wall which cannot sustain the load imposed by the weight of the shelving and the books or other objects carried by the shelving.

SUMMARY OF THE INVENTION

It is, therefore, a principal object of the present invention to provide an adjustable shelf system which can be used in combination with a non-load bearing wall and which does not require penetration of the non-load bearing wall for its support.

It is a further object of the invention to provide an adjustable shelf system which can be utilized in combination with a prefabricated wall having a decorative exterior surface which does not require penetration of the wall for its support and yet which derives stability from the prefinished wall without engaging it in abrasive contact.

According to the best mode now contemplated, the invention is practiced in combination with a non-load bearing wall of the type which is supported intermediate a building foundation and an upstanding load bearing frame which includes a top track member having channels for receiving and engaging the prefabricated panel sections. The adjustable shelf system includes first and second laterally spaced, upstanding tubular support legs each having an end portion engaging the foundation adjacent the non-load bearing wall and having side portions enclosing a central chamber and a channel formed in one of the side wall portions. A cushion strip is confined in each channel intermediate the support leg and the support wall thereby preventing abrasive contact of the tubular support leg against the decorative panel surface. Horizontal bracket members attached to the upstanding tubular support legs provide parallel surfaces for supporting shelves. An extendable tubular member is coaxially received in the central chamber of the upper end of each of the tubular support legs and projects above the support legs to an elevation substantially flush with the top side surface of the top track member. A fastener mechanically interconnects the extendable tubular member to the top track member for preventing lateral displacement of the tubular support legs relative to the wall.

According to a preferred embodiment, for heavy load duty, a rectangular array of tubular support legs is provided with the bracket members interconnecting adjacent support legs and the shelves being rigidly fastened to the bracket members. Extendable tubular members are also coaxially received in the additional tubular support legs and are interconnected to the wall adjacent tubular support legs and to the top track member by means of beam members which overlie the extendable tubular members and the top track member. The bracket members in this arrangement are preferably trifurcated with offset finger portions defining a receptacle for engaging opposite side portions of the tubular support legs.

The novel features which characterize the invention are set forth in the appended claims. The invention itself, however, as well as other objects and advantages thereof, may best be understood by reference to the following detailed description of preferred embodiments, and to the appended drawing.

DETAILED DESCRIPTION

Figure 1:
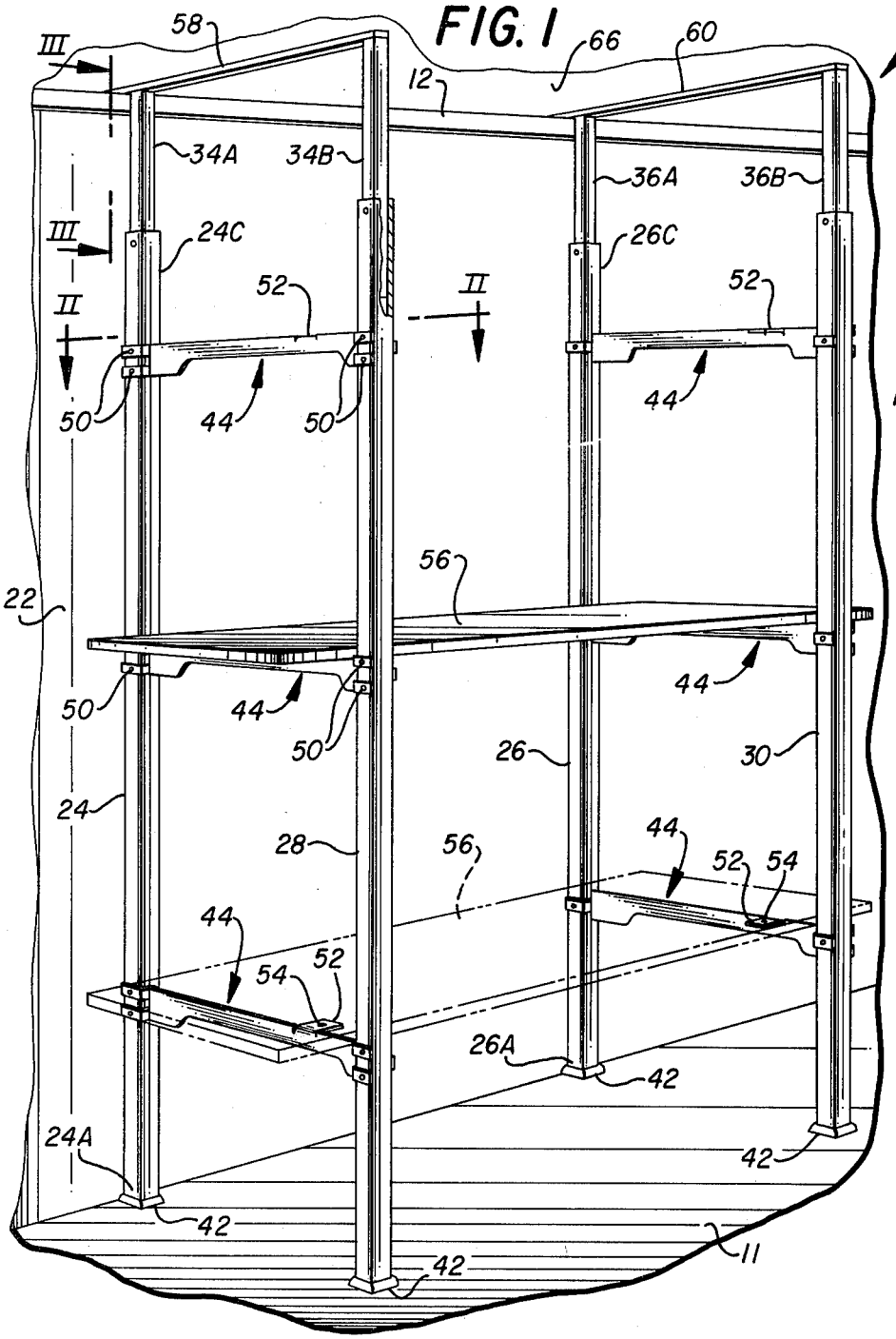
FIG. 1 is a perspective view of an adjustable shelf system constructed according to the teachings of the present invention.

In the description which follows, like parts are marked throughout the specification and drawing with the same reference numerals, respectively. The various views of the drawing are not necessarily drawn to scale and in some instances structural portions have been exaggerated in order to more clearly depict certain features of the invention.

Referring now to FIG. 1 of the drawing, a heavy load duty adjustable shelf system constructed according to the teachings of the invention is illustrated. The adjustable shelf system 10 is shown installed in a modern office building which includes a structurally reinforced elevated floor 11 from which an upstanding load bearing frame including a top track member 12 is supported. The top track member 12 is of conventional extruded aluminum construction and includes a central channel 14 in which a wooden or metal stud 15 is lodged and lateral channels 16, 18 on opposite sides of the central channel for receiving and engaging the edge portions of a pair of prefabricated non-load bearing wall panels 20, 22 as can best be seen in FIG. 3.

The heavy load duty adjustable shelf system 10 shown in FIG. 1 is stabilized by a rectangular array of upstanding tubular support legs 24, 26, 28 and 30. The tubular support legs 24, 26 are laterally spaced with respect to each other and each includes an end portion 24A, 26A engaging the floor 11, a side surface 24B, 26B, respectively disposed adjacent the wall panel 22 and side portions which define a central chamber 32.

An extendable tubular member 34, 36 is coaxially received in the central chamber 32 at the upper end 24C, 26C, respectively, for deriving the load bearing support from the top track member 12 as will be described hereinafter. The extendable tubular members 34, 36 project above the tubular support legs at an elevation substantially flush with the top side surface of the top track member 12.

Figure 2:
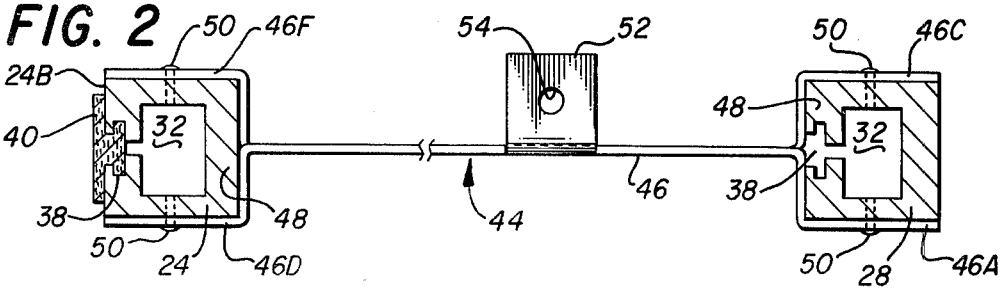
FIG. 2 is a sectional view taken along the lines II-II of FIG. 1.

Referring now to FIG. 2, the construction of the extruded tubular support leg is illustrated. Each tubular support leg 24, 26, 28 and 30 has identical construction and includes the central chamber 32 and a T-shaped channel 38 which preferably extends along the length of the support leg. A cushion strip 40 of a backing material such as elastomeric tape, felt strip or the like is lodged in the channel 38 and is disposed intermediate the channel side portion 24B of the support leg and the finished surface of the non-load bearing wall panel to prevent abrasive contact of the tubular support leg of the decorative panel surface. Also for this purpose felt, elastomeric sponge material or the like cushioning material is carried either continuously or at spaced intervals along the rear side surface 24B of the tubular support leg. The cushion 40 is of sufficient thickness to compress lightly as the tubular support leg is set up adjacent to the wall panel 22.

It is desirable that each tubular support leg be equipped with a resilient pad 42 fitted over the end portions of the tubular support legs to uniformly distribute the loading imposed on each support leg, thereby minimizing the gouging effect on the floor 11.

Figure 5:
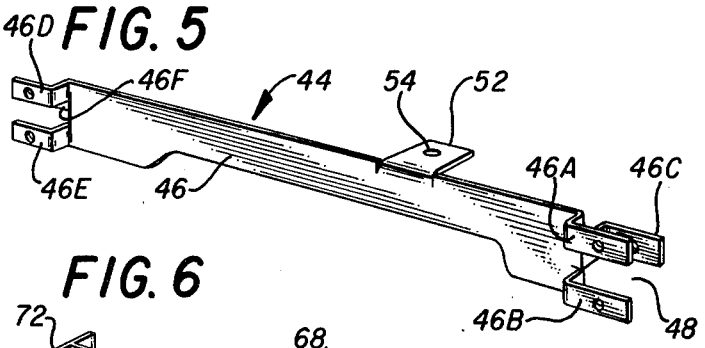
FIG. 5 is a perspective view of a shelf bracket shown in FIG. 1.

The tubular support legs are interconnected by means of identical bracket members 44. One preferred construction of the bracket 44 is illustrated in FIGS. 2 and 5 of the drawing. According to this preferred construction, the bracket 44 comprises an elongated shank portion 46 having trifurcated end portions which are formed by three finger members 46A, 46B and 46C on one end and 46D, 46E and 46F on the opposite end. The finger members are spaced in parallel relation to each other and are laterally offset relative to the longitudinal axis of the shank 46. Together these finger portions define a receptacle 48 for engaging opposite side portions of the tubular support legs. The finger portions and the tubular support legs are joined together by means of threaded, self-tapping screw fasteners 50. A preferred fastener 50 is "TEKSCREW" which is commonly available.

Each of the brackets 44 includes a horizontally projecting flange 52 which has an opening 54 through which a wood screw or other such fastener projects for engagement with the underside of an overlying shelf 56. This arrangement serves to further stabilize the assembly and to anchor the shelf 56 to the brackets 44.

Figure 3:
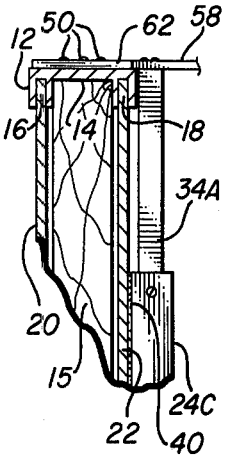
FIG. 3 is a sectional view taken substantially along the lines III-III of FIG. 1.
Figure 4:
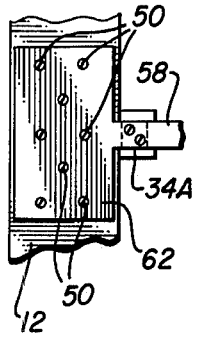
FIG. 4 is a partial top plan view of a portion of the structure shown in FIG. 3.
Figure 11:
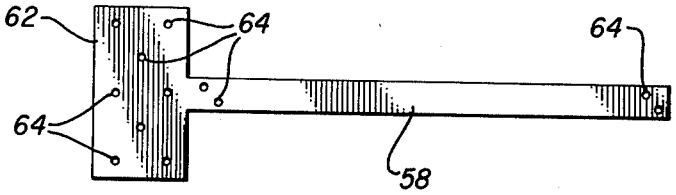
FIG. 11 is a top plan view of a fastener shown in FIG. 1.

According to the invention, beam members 58, 60 mechanically interconnect each of the extendable tubular members 34A, 34B, 36A and 36B to prevent lateral displacement of the tubular support legs relative to the wall and to derive load bearing support from the top track member 12. In this arrangement, the beam members 58, 60 overlie the extendable tubular members and also overlie the top track member 12 as can be seen in FIGS. 3 and 4 of the drawing. The construction of the beam member 58 is illustrated in detail in FIG. 11 of the drawing. According to this preferred construction, the beam member 58 includes an elongated shank portion projecting from a rectangular plate 62 having a number of predrilled holes 64 for receiving the fasteners 50. The rectangular plate 62 of the beam member is fastened directly onto the topmost surface of the top track member 12 with an intermediate portion of the shank being fastened to the top of the extendable tubular member 34A and the opposite end of the shank being similarly fastened to the top of the extendable tubular member 34B. The beam member 60 is similarly fastened to the top track member 12 and to the extendable members 36A, 36B.

According to conventional practice, a ceiling 66 is suspended above the floor and includes a number of acoustical tile panels (not shown) which are supported in a suspended grid framework. It is preferred that in such an arrangement, the beam members 58, 60 have substantially the same thickness as the suspended grid framework whereby the rectangular plate 62 and shank portion of the beam can be inserted in the space between the acoustical tile and the top track member 12 without disturbing the appearance of the acoustical tile arrangement.

Figure 6:
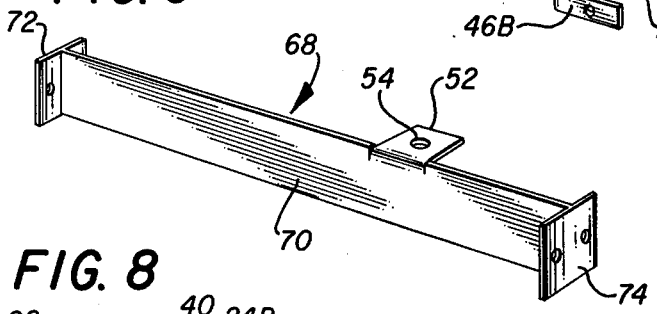
FIG. 6 is a perspective view of an alternate embodiment of a shelf bracket suitable for use in the assembly shown in FIG. 1.

In FIG. 6, a bracket 68 is illustrated which represents an alternate bracket embodiment. The bracket 68 comprises generally an elongated shank portion disposed intermediate planar end portions 72, 74 which are parallel to each other and which project orthogonally with respect to the shank body portion. Openings are provided for receiving screw fasteners which secure the planar end portions 72, 74 to the innermost side portions of the tubular support legs.

Figure 8:
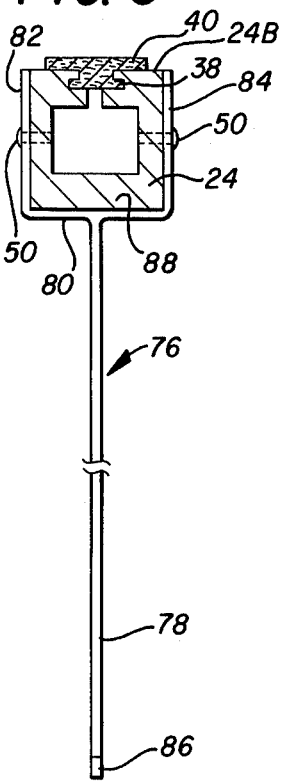
FIG. 8 is a sectional view taken along the line VIII-VIII of FIG. 7.
Figure 7:
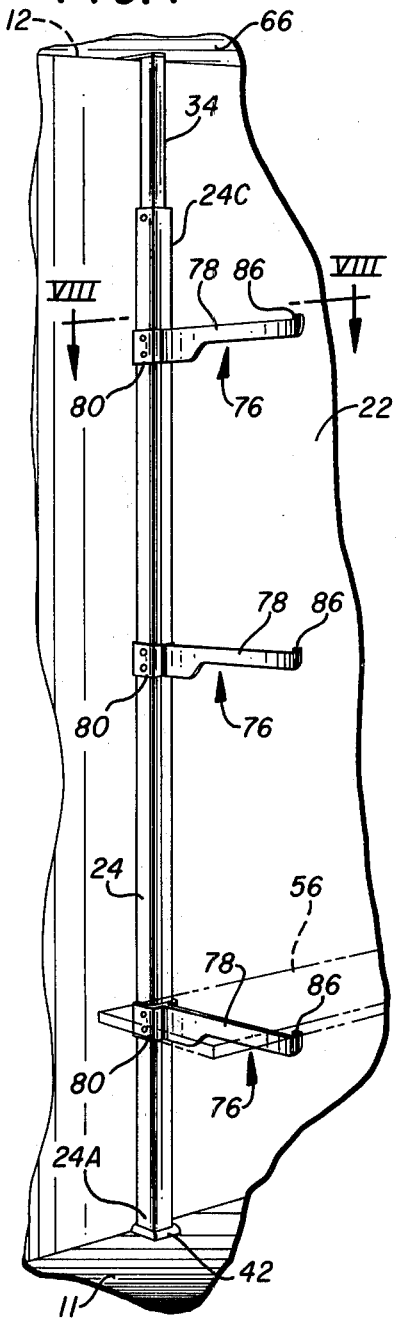
FIG. 7 is a partial perspective view of an alternative shelf system.
Figure 10:
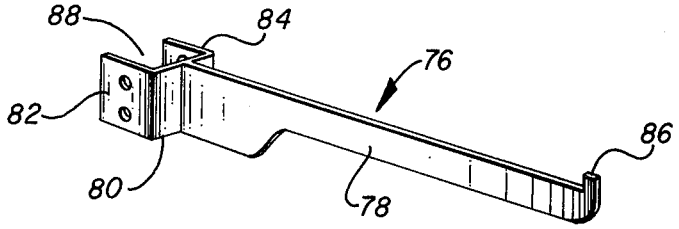
FIG. 10 is a perspective view of a shelf bracket shown in FIG. 7.

Referring now to FIG. 7, an adjustable shelf system designed for relatively light load duty is illustrated. In this arrangement the additional tubular support legs are not required with support being derived solely from the top track member 12. In this arrangement, a bracket 76 provides the support for the shelves 56. Referring to FIG. 10, the bracket 76 includes an elongated shank portion 78, a bifurcated end portion 80 including first and second finger portions 82, 84 and a hooked end portion 86. The finger portions 82, 84 define a receptacle 88 for receiving and engaging opposite side portions of the tubular support legs, with the hooked end portions defining a mechanical stop for limiting displacement of the shelf 56 relative to the brackets. Engagement of the finger members 82, 84 with the upstanding tubular support leg 24 is illustrated in FIG. 8 of the drawing. Although the arrangement shown in FIG. 7 is not as mechanically stable as the arrangement shown in FIG. 1, it may be used to good advantage for relatively light load duty.

Figure 9:
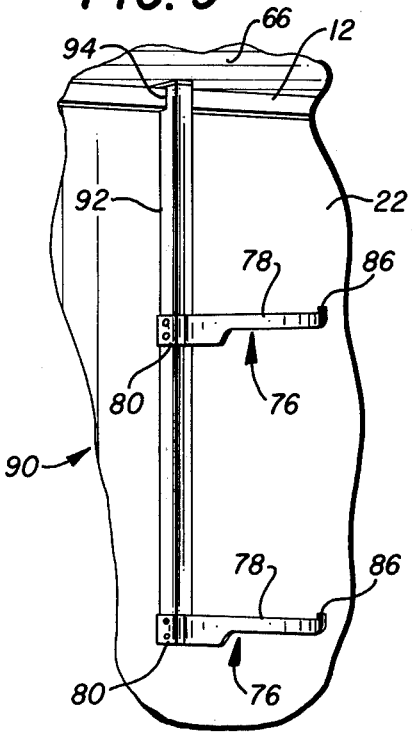
FIG. 9 is a partial perspective view of a suspended adjustable shelf system constructed according to the teachings of the invention.

Referring to FIG. 9, a suspended shelf system 90 is illustrated. The suspended shelf system 90 is intended for relatively light load duty in combination with a non-load bearing wall 22 where access to the floor 11 is not required. First and second laterally spaced tubular support legs 92 are laterally spaced relative to each other and include a side portion adjacent to the prefabricated wall and a channel formed in the side portion as shown in FIG. 2 of the drawing. A cushion strip 40 is confined in the channel to prevent abrasive contact of the tubular support leg 92 as previously discussed. A plurality of brackets 76 are supported in cantilever engagement and project orthogonally from the support legs 92. The brackets 76 are aligned in elevation with each other to support rectangular shelving in the usual manner. The upper end of the support leg 92 is provided with a notch 94 for receiving the down turned edge of the top track member 12 so that the support leg 92 and cushion 40 will be flush against the wall 22. Primary support for the support leg 92 is provided by a beam member similar to the beam 58 with its shank portion truncated.

Figure 12:
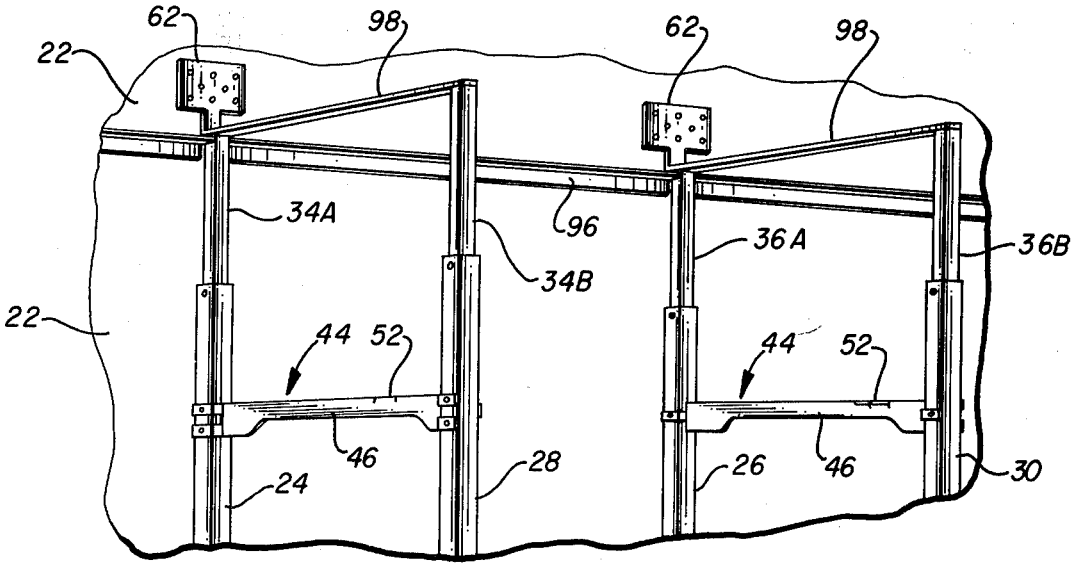
FIG. 12 is a perspective view which illustrates an alternate anchoring arrangement for the adjustable shelf system shown in FIG. 1.

Referring now to FIG. 12, in some installations the wall 22 will extend vertically beyond the suspended ceiling 66. In this arrangement, an L-shaped flange 96 is provided for receiving the peripheral end edge portions of acoustical tile panels. In this arrangement, the top track member 12 is not used and in some installations will be located too high above the suspended ceiling to be useful for coupling to the shelf system. Therefore in this arrangement a modified beam 98 is provided having a rectangular tie plate 62 projecting at a right angle with respect to the beam for mounting on the portion of the wall 22 which is above the suspended ceiling. Connection of the plate 62 to the wall is made by conventional screw fasteners. Connection from the beam 98 to the extendable tubular members 34A, 34B, 36A and 36B is made with screw fasteners according to the method previously described.

Although a preferred embodiment of the invention has been described in detail, it should be understood that various changes, substitutions and alterations can be made therein without departing from the spirit and scope of the invention as defined by the appended claims.

What is claimed is:

1. An adjustable shelf system for installation in combination with a non-load bearing wall including prefabricated panel sections characterized by a decorative exterior surface, said non-load bearing wall being supported intermediate a building foundation and an upstanding load bearing frame projecting from said foundation including a load bearing top track member, said adjustable shelf system comprising, in combination:

first and second laterally spaced, upstanding tubular support legs each having end portions engaging said foundation adjacent said non-load bearing wall and having side portions enclosing a central chamber and a channel formed within one of said side portions;

a cushion strip confined in each channel and overlying said channel side portion, said cushion strip having a shield portion disposed intermediate said channel side portion of said support leg and the decorative surface of said non-load bearing wall thereby preventing abrasive contact of the tubular support leg against the decorative panel surface;

third and fourth laterally spaced, upstanding tubular support legs disposed in parallel relation with said first and second tubular support legs;

a first plurality of bracket members mechanically interconnecting said first and third tubular support legs, said bracket members being disposed in parallel relation with said foundation;

a second plurality of bracket members mechanically interconnecting said second and fourth tubular support legs, said bracket members being disposed in parallel relation with said foundation;

a rectangular shelf having first and second end portions resting on a selected pair of said brackets and laterally confined intermediate said first and third upstanding tubular support legs and said second and fourth upstanding tubular support legs, respectively;

an extendable tubular member coaxially received in the central chamber of the upper end of each of said first and second tubular support legs and projecting above said tubular support legs to an elevation substantially flush with the top side surface of said top track member; and fastener means mechanically interconnecting each extendable tubular member to said top track member for deriving load bearing support and for preventing lateral displacement of said tubular support legs relative to said wall.

2. The adjustable shelf system as defined in claim 1, each of said bracket members including a horizontally projecting flange for supporting and anchoring one end of said shelf to said bracket, said combination further including fastener means engaging said flange and said shelf for anchoring said shelf to said bracket.

3. The adjustable shelf system as defined in claim 1, the combination including an extendable tubular member coaxially received in the central chamber of the upper end of each of said third and fourth tubular support legs and projecting above said tubular support legs to an elevation substantially flush with the top side surface of said top track member, said fastener means comprising first and second beam members laterally spaced in parallel relation, said beam members each having an end portion overlying and attached to said top track, said beam members overlying and being mechanically attached to the extendable tubular members of said first and second tubular support legs and said third and fourth tubular support legs, respectively.

4. The adjustable shelf system as defined in claim 1, said bracket members each having an elongated shank terminated by trifurcated end portions, each trifurcated end portion being characterized by first and second finger members spaced in parallel relation to each other and laterally offset relative to the longitudinal axis of said shank and a third finger portion disposed intermediate said first and second finger portions, said third finger portion being laterally offset relative to the longitudinal axis of said shank, said finger portions defining a receptacle for engaging opposite side portions of said tubular support legs.

5. The adjustable shelf system as defined in claim 1, said bracket members having an elongated shank body portion disposed intermediate planar end portions, said planar end portions being parallel to each other and projecting orthogonally with respect to said shank body portion.

6. An adjustable shelf system for installation in combination with a non-load bearing wall including prefabricated panel sections characterized by a decorative exterior surface, said non-load bearing wall being supported intermediate a building foundation and an upstanding load bearing frame projecting from said foundation including a top track member, said adjustable shelf system comprising, in combination:

first and second laterally spaced, upstanding tubular support legs each having end portions engaging said foundation adjacent said non-load bearing wall and having side portions enclosing a central chamber and a channel formed within one of said wall portions;

a cushion strip confined in each channel and overlying said channel side portion, said cushion strip having a shield portion disposed intermediate said channel side portion of said support leg and said decorative surface of said non-load bearing wall thereby preventing abrasive contact of the tubular support leg against said decorative panel surface;

an extendable tubular member coaxially received in the central chamber of the upper end of each of said first and second tubular support legs and projecting above said tubular support legs to an elevation substantially flush with the top side surface of said top track member;

a first plurality of bracket members mechanically attached to and projecting orthogonally from said first upstanding tubular support leg, said first bracket members being vertically spaced in parallel relation;

a second plurality of bracket members mechanically attached to and projecting orthogonally from said second upstanding tubular support legs, said second bracket members being vertically spaced in parallel to each other and being aligned in elevation with corresponding ones of said first bracket member;

rectangular shelving supported by aligned pairs of said first and second bracket members; and fastener means mechanically interconnecting each extendable tubular member to said top track member for preventing lateral displacement of said tubular support legs relative to said wall.

7. The adjustable shelf system as defined in claim 6, said bracket members each comprising an elongated shank portion having a bifurcated end portion and a hooked end portion, said bifurcated end portion including first and second finger portions spaced in parallel relation to each other and laterally offset relative to the longitudinal axis of said shank, said finger portions defining a receptacle for engaging opposite side portions of said tubular support legs, and said hooked end portions defining a mechanical stop for limiting transverse displacement of said shelf relative to said brackets.

8. A suspended shelf system for installation in combination with a non-load bearing wall including prefabricated panel sections characterized by a decorative exterior surface, said non-load bearing wall being supported intermediate a building foundation and an upstanding load bearing frame projecting from said foundation including a top track member, said suspended shelf system comprising, in combination:

first and second laterally spaced tubular support legs each having a side portion adjacent said wall and a channel formed in said side portion;

a cushion strip confined in each channel and overlying said channel side portion, said cushion strip having a shield portion disposed intermediate said channel side portion of said support leg and said decorative surface of said non-load bearing wall thereby preventing abrasive contact of the tubular support leg against said decorative panel surface;

a first plurality of bracket members mechanically attached to and projecting orthogonally from said first tubular support leg, said first bracket members being vertically spaced in parallel relation;

a second plurality of bracket members mechanically attached to and projecting orthogonally from said second tubular support leg, said second bracket members being vertically spaced in parallel to each other and being aligned in elevation with corresponding ones of said first bracket members;

rectangular shelving supported by aligned pairs of said first and second bracket members; and fastener means mechanically interconnecting the uppermost portion of each support leg to said top track member for maintaining said support leg and bracket assembly suspended above said foundation.

* * * * *